US009284893B2

(12) United States Patent
Kamada

(10) Patent No.: US 9,284,893 B2
(45) Date of Patent: Mar. 15, 2016

(54) APPARATUS AND METHOD FOR CONTROLLING ROTATION SPEED OF INTERNAL COMBUSTION ENGINE

(75) Inventor: Shinobu Kamada, Yokohama (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 179 days.

(21) Appl. No.: 14/346,988

(22) PCT Filed: Aug. 29, 2012

(86) PCT No.: PCT/JP2012/071790

§ 371 (c)(1),
(2), (4) Date: Mar. 25, 2014

(87) PCT Pub. No.: WO2013/061684

PCT Pub. Date: May 2, 2013

(65) Prior Publication Data

US 2014/0238345 A1 Aug. 28, 2014

(30) Foreign Application Priority Data

Oct. 24, 2011 (JP) ..... 2011-232361

(51) Int. Cl.

| | |
|---|---|
| ***F02D 41/00*** | (2006.01) |
| ***F02D 15/02*** | (2006.01) |
| ***F02D 31/00*** | (2006.01) |
| *F02B 75/04* | (2006.01) |

(52) U.S. Cl.

CPC ..... *F02D 15/02* (2013.01); *F02D 31/001* (2013.01); *F02D 31/002* (2013.01); *F02B 75/048* (2013.01)

(58) Field of Classification Search

CPC ..... F02D 41/00; F02D 41/08; F02D 15/02; F02D 31/001; F02D 31/002; F02B 75/048

See application file for complete search history.

(56) References Cited

U.S. PATENT DOCUMENTS 7,412,954 B2 * 8/2008 Shiino ..... F01L 1/34 123/179.16

FOREIGN PATENT DOCUMENTS

| | | | | |
|---|---|---|---|---|
| JP | 2709061 B2 | | 2/1998 | |
| JP | 2002-235567 A | | 8/2002 | |
| JP | 2004-239146 A | | 8/2004 | |
| JP | 2005-155507 A | | 6/2005 | |
| JP | 2008-138554 A | | 6/2008 | |
| JP | 2011226472 A | * | 11/2011 | ..... F02D 41/04 |

* cited by examiner

*Primary Examiner* — Hieu T Vo

(74) *Attorney, Agent, or Firm* — Drinker Biddle & Reath LLP

(57) ABSTRACT

Rotation speed control apparatus including an electronically controllable throttle valve capable of changing an intake air quantity, a variable compression ratio mechanism capable of changing a mechanical compression ratio, and an ECU configured to calculate a deviation between a target idle rotation speed and an actual rotation speed during idle operation, select either one or both of the intake air quantity and the mechanical compression ratio as control targets in accordance with magnitude of the deviation, and reduce the deviation by changing the selected either one or both of the intake air quantity and the mechanical compression ratio.

15 Claims, 10 Drawing Sheets

APPARATUS AND METHOD FOR CONTROLLING ROTATION SPEED OF INTERNAL COMBUSTION ENGINE

TECHNICAL FIELD

The present invention relates to rotation speed control for an internal combustion engine.

BACKGROUND ART

As well known in the art, in an internal combustion engine mounted on a vehicle, so-called idle rotation speed control is performed, in which an engine rotation speed is converged to a target idle rotation speed by increasing or decreasing intake air quantity (intake air amount) using a throttle valve or the like in accordance with a deviation between the target idle rotation speed and an actual rotation speed of the internal combustion engine detected by the crank angle sensor or the like.

On the other hand, there have been proposed variable compression ratio mechanisms capable of changing a mechanical compression ratio of the internal combustion engine (expansion ratio) by varying a piston stroke characteristic in accordance with an engine operating condition, by the present applicant and others. As an example of idle rotation speed control using such a variable compression ratio mechanism, Patent Literature 1 recites a technology in which an actual compression ratio is detected by a compression ratio sensor and an intake air quantity is corrected in accordance with the actual compression ratio so as to suppress deterioration of convergence of the idle rotation speed control due to a response delay caused upon changing the compression ratio.

Further, Patent Document 2 recites a technology in which idle rotation speed control is performed by conducting ignition timing control in combination with intake quantity control by the throttle valve. During idling, an ignition timing is corrected on the basis of an actual intake quantity detected by an air flow meter, while an intake quantity is increased or decreased by adjusting an throttle opening degree so as to maintain a target idle rotation speed.

CITATION LIST

Patent Literature

Patent Literature 1: Japanese Patent Application Unexamined Publication No. 2004-239146

Patent Literature 2: Japanese Patent No. 2709061

SUMMARY OF INVENTION

Technical Problem

Since the throttle valve is located on an upstream side of the intake passage relatively spaced apart from a cylinder, adjustment of the intake air quantity by the throttle valve is carried out with a certain degree of response delay. Therefore, there is such a problem that when rotation speed control is carried out only by increasing or decreasing the intake air quantity using the throttle valve, especially in a case where a deviation between the actual rotation speed and the target rotation speed is relatively small, convergence of the deviation is deteriorated. On the other hand, as recited in Patent Literature 2, in a case where the ignition timing control is conducted in combination with the rotation speed control, it is necessary to previously retard the ignition timing so as to allow advance of the ignition timing. Due to the retard of the ignition timing, an amount of retard relative to appropriate ignition timing (MBT) is increased, thereby causing deterioration of fuel economy performance.

Solution to Problem

The present invention was made in view of such circumstances. The present invention aims to sufficiently converge a deviation between an actual rotation speed and a target rotation speed in the rotation speed control by conducting both intake air quantity change control and mechanical compression ratio change control. That is, a feature of the present invention resides in that during execution of rotation speed control in which the actual engine speed of the internal combustion engine is brought close to the target rotation speed, a deviation between the actual rotation speed and the target rotation speed is reduced by calculating the deviation, selecting either one or both of the intake air quantity and the mechanical compression ratio as control targets in accordance with magnitude of the deviation, and changing the selected either one or both of the intake air quantity and the mechanical compression ratio.

Effect of Invention

According to the present invention, it is possible to sufficiently converge a deviation between the actual rotation speed and the target rotation speed during the rotation speed control by conducting intake air quantity change control and mechanical compression ratio change control.

DESCRIPTION OF EMBODIMENTS

Figure 1:
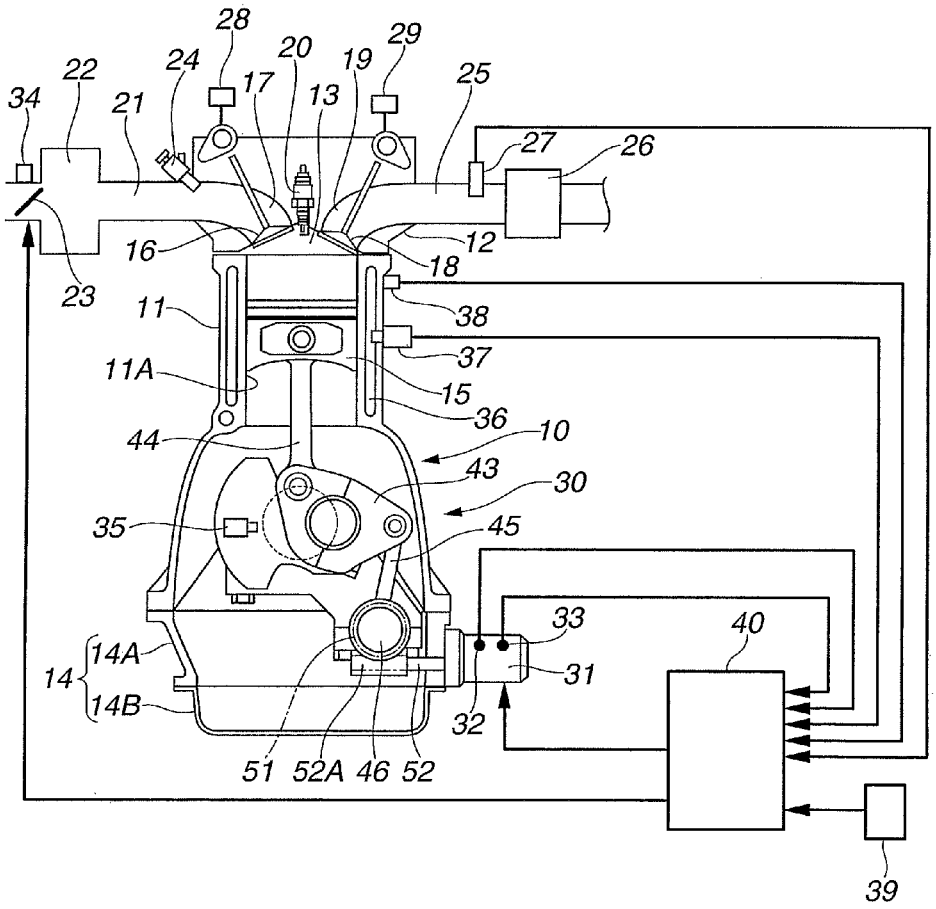
FIG. 1 is a system configuration diagram of an internal combustion engine to which an idle rotation speed control apparatus according to an embodiment of the present invention is applicable.

In the following, a preferred embodiment of the present invention is explained with reference to the accompanying drawings. FIG. 1 is a configuration diagram showing a system configuration of a spark-ignition gasoline engine of a port injection type to which the present invention is applicable. Internal combustion engine 10 includes cylinder block 11 provided with a plurality of cylinders (bore) 11A, and cylinder head 12 fixed on an upper side of cylinder block 11. Mounted on a lower side of cylinder block 11 is oil pan 14 that stores an engine oil. Oil pan 14 includes two split parts, i.e., upper oil pan 14A and lower oil pan 14B. In FIG. 1, only one cylinder 11A is depicted, but actually, a plurality of cylinders 11A are arranged in a direction of a row of the cylinders.

Piston 15 is slidably disposed in each of cylinders 11A. Disposed above piston 15 is combustion chamber 13 that is formed between piston 15 and a lower surface of cylinder head 12 of a pent roof type. Intake port 17 is connected to each combustion chamber 13 via intake valve 16, and exhaust port 19 is connected to each combustion chamber 13 via exhaust valve 18. Further, ignition plug 20 to spark-ignite an air-fuel mixture is disposed at a top center of combustion chamber 13.

Disposed in intake passage 21 connected to intake port 17 of each cylinder is electronically controllable throttle valve 23 that adjusts an intake air quantity (intake air amount), on an upstream side of intake air collector 22. Further, fuel injection valve 24 that injects fuel toward intake port 17 of each cylinder is disposed in intake passage 21. Incidentally, the fuel injection configuration is not limited to such a port injection type, and may be a configuration of an in-cylinder direct injection type in which fuel is directly injected into the combustion chamber. In addition, an air flow meter (not shown) that detects an intake air quantity, an air filter (not shown) that collects a foreign matter in intake air, and the like are disposed on the upstream side of throttle valve 23.

Disposed in exhaust passage 25 to which exhaust ports 19 of respective cylinders are connected and collected is catalyst 26 such as a three-way catalyst or the like. Further, air-fuel ratio sensor 27 such as an oxygen concentration sensor or the like which detects an air-fuel ratio of exhaust gas is disposed on an upstream side of catalyst 26 (and a downstream side thereof). Based on a detection signal of air-fuel ratio sensor 27, air-fuel ratio feedback control to increase or decrease a fuel injection amount such that the air-fuel ratio of the exhaust gas is maintained at a target air-fuel ratio (stoichiometric air-fuel ratio) is performed.

Further, internal combustion engine 10 includes intake-side variable valve operating mechanism 28 capable of changing a valve lift characteristic of intake valve 16 and exhaust-side variable valve operating mechanism 29 capable of changing a valve lift characteristic of exhaust valve 18 in addition to the above-described electronically controllable throttle valve 23, which serve as devices capable of changing the intake air quantity. A variable valve timing mechanism configured to retard or advance a valve timing by retarding or advancing an angular phase of a camshaft relative to a crankshaft, a lift operation angle changing mechanism capable of simultaneously and continuously changing both an operation angle and a valve lift amount of the intake valve or the exhaust valve, and the like as recited in Japanese Patent Application Unexamined Publication No. 2002-235567, etc. can be used as variable valve operating mechanisms 28 and 29. Configurations of these mechanisms are generally known, and therefore, explanations therefor are omitted.

Further, there is provided variable compression ratio mechanism 30 as a device capable of changing a mechanical compression ratio (expansion ratio) of the internal combustion engine. Variable compression ratio mechanism 30 is capable of changing a mechanical compression ratio by changing a piston stroke characteristic including the bottom dead center position and the top dead center position of piston 15. Built in electric motor 31 as an actuator for driving variable compression ratio mechanism 30 are electric motor rotation angle sensor 32 that detects a rotation angle of electric motor 31 corresponding to an actual mechanical compression ratio, and electric motor load sensor 33 that detects a load of motor 31.

There are provided various sensors for detecting an engine operating condition, which include throttle opening degree sensor 34 for detecting a throttle opening degree of throttle valve 23, crank angle sensor 35 for detecting a crank angle of crankshaft 41, water temperature sensor 37 for detecting a temperature of a cooling water of water jacket 36, that is, detecting an engine water temperature, knock sensor 38 for sensing knocking, accelerator opening sensor 39 for detecting accelerator opening degree APO of an accelerator pedal operated by a vehicle driver, etc.

ECU (engine control unit) 40 as a control unit includes a microcomputer having a function of storing and executing various control process. ECU 40 outputs control signals to throttle valve 23, ignition plug 20, fuel injection valve 24, variable valve operating mechanisms 28, 29, electric motor 31 of variable compression ratio mechanism 30 and the like, and controls the operation thereof.

Figure 2:
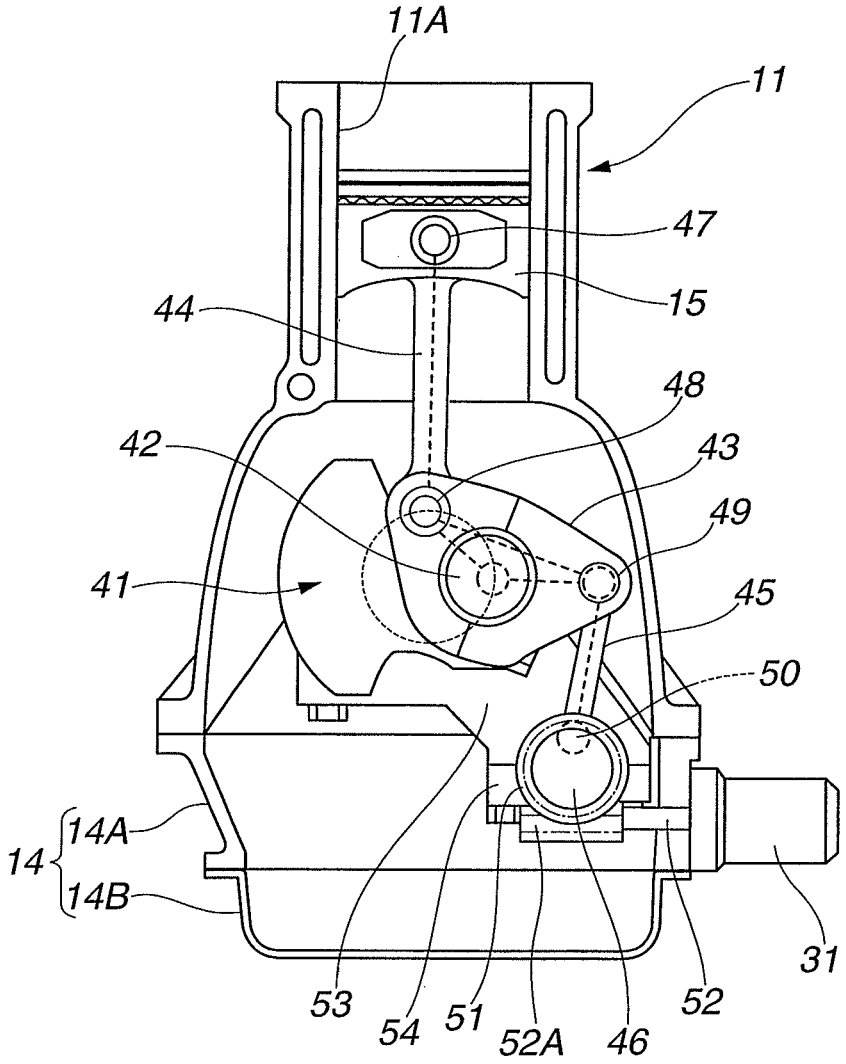
FIG. 2 is a configuration diagram showing a variable compression ratio mechanism of the internal combustion engine.
Figure 3:
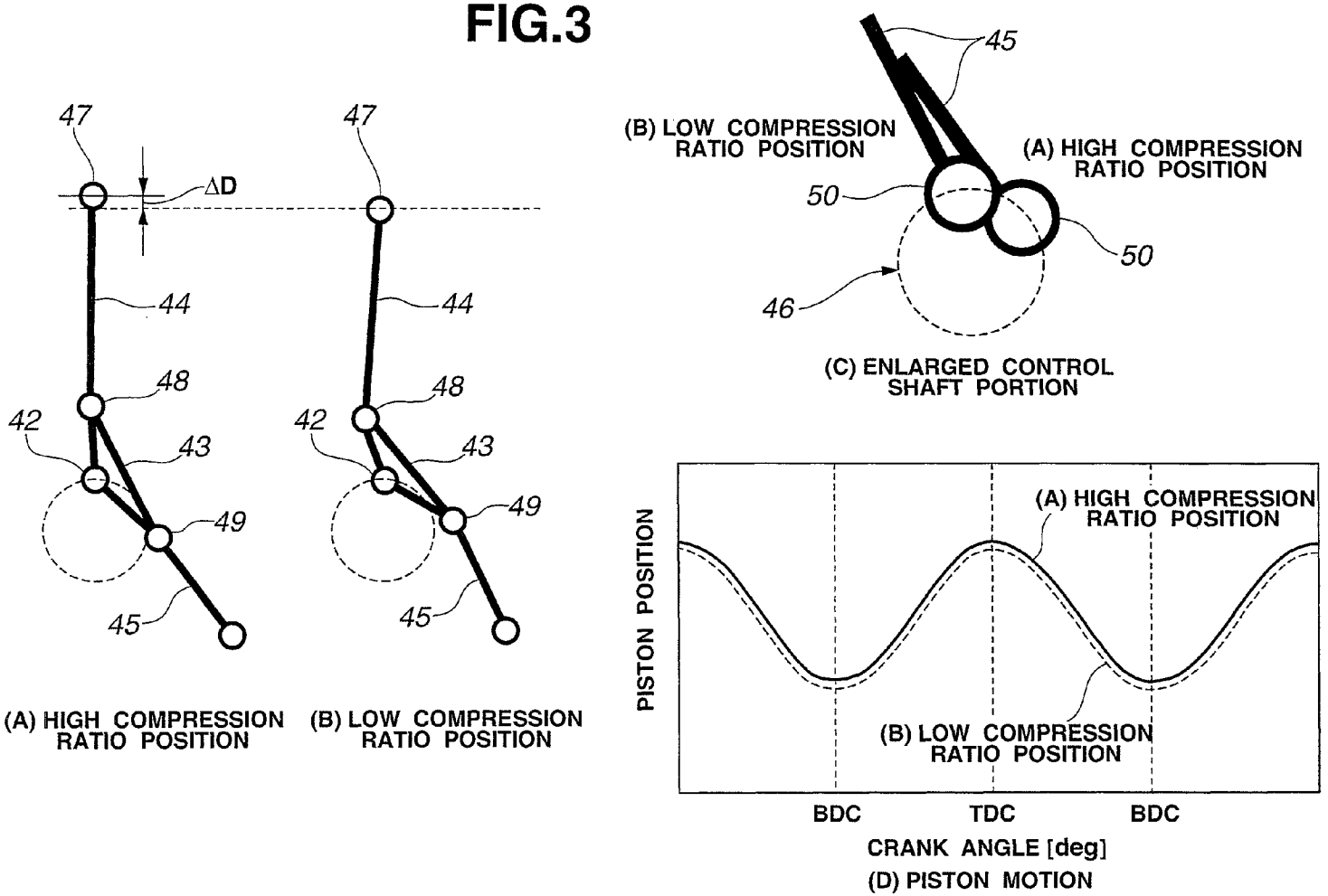
FIG. 3 is an explanatory diagram showing the variable compression ratio mechanism, in which (A) and (B) are explanatory diagrams showing a link layout in a high compression ratio position and a link layout in a low compression ratio position, respectively, (C) is an enlarged view of a vicinity of a control shaft, and (D) is an explanatory diagram showing a piston motion.
Figure 4:
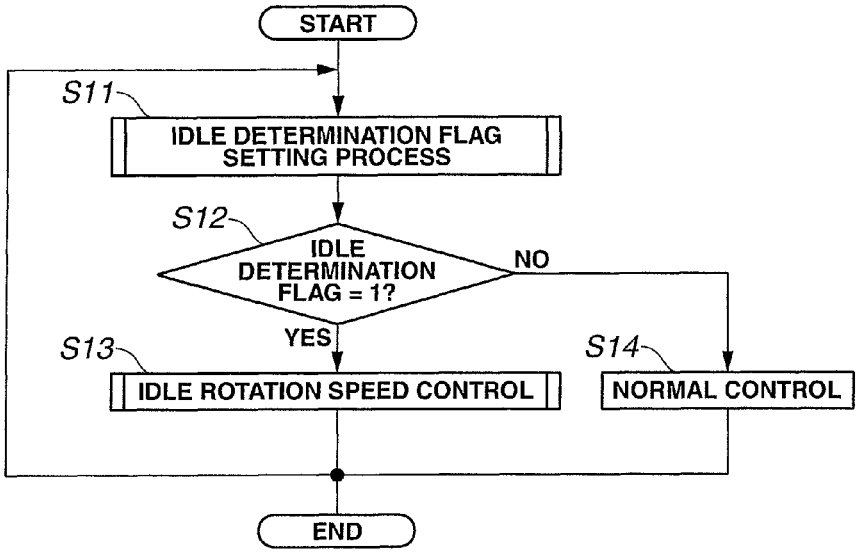
FIG. 4 is a flow chart showing a flow of the idle rotation speed control according to the embodiment.

Referring to FIG. 2 to FIG. 4, there is shown the above-described variable compression ratio mechanism 30 capable of changing a mechanical compression ratio by using a double-link piston-crank mechanism that mechanically transmits a combustion pressure applied to piston 15 of each cylinder as a rotational power to crankshaft 41. As also shown in FIG. 2, crank shaft 41 is provided with crank pin 42 for each cylinder which is eccentric relative to a journal center thereof. Variable compression ratio mechanism 30 includes lower link 43 rotatably mounted on crank pin 42, upper link 44 connecting lower link 43 and piston 15 to each other, and control link 45 connecting lower link 43 and control shaft 46 to each other. Upper link 44 is a link part having a rod shape. An upper end of upper link 44 is pivotally connected to piston 15 through piston pin 47, and a lower end of upper link 44 is pivotally connected to lower link 43 through first connecting pin 48. Lower link 43 is configured to split into two members that sandwich crank pin 42 therebetween. An upper end of control link 45 is pivotally connected to lower link 43 through second connecting pin 49. First connecting pin 48 and second connecting pin 49 are disposed on opposite sides with respect to a center of crank pin 42. A lower end of control link 45 is pivotally attached to eccentric shaft portion 50 eccentrically disposed on control shaft 46.

Control shaft 46 is rotatably supported on a side of cylinder block 11 by means of main bearing cap 53 and sub-bearing cap 54. Control shaft 46 has gear 51 on an outer periphery thereof which meshes with pinion 52A disposed on rotational shaft 52 of electric motor 31. By changing a rotational position of control shaft 46 by electric motor 31, a position of eccentric shaft portion 50 is displaced. In accordance with the displacement of eccentric shaft portion 50, an attitude of lower link 43 is changed through control link 45 so that a piston stroke characteristic including the piston top dead center position and the piston bottom dead center position is changed.

As shown in FIG. 3, when the rotational position of control shaft 46 is located in high compression ratio position (A), the piston top dead center position (for the sake of convenience, as represented as the center position of piston pin 47 in the drawing) is in a high position. When the rotational position of control shaft 46 is located in low compression ratio position (B), the piston top dead center position is in a position lower than the high compression ratio position (A) by a predetermined amount AD. FIG. 3(D) shows piston motion in each of the high compression ratio position (A) and the low compression ratio position (B), that is, a piston stroke characteristic.

Such variable compression ratio mechanism 30 can change the mechanical compression ratio depending on the engine operating condition. In addition, variable compression ratio mechanism 30 can set the piston stroke characteristic itself to an appropriate characteristic approximate to simple harmonic motion as shown in FIG. 3(D), by appropriately setting the link layout as shown in FIG. 3(A), (B). Further, a load acting on a contact portion between the piston and a cylinder wall in a thrust direction and an anti-thrust direction can be suppressed by restricting a swing angle of upper link 44 relative to piston pin 47 to a small angle. Furthermore, the connecting portion of the link part is mostly in a surface contact, and therefore, lubrication can be facilitated, and excellent reliability and durability can be attained. Further, control shaft 46 is arranged in a diagonally downward position of crankshaft 41 and in the vicinity of a side wall of upper oil pan portion 14A. With this arrangement, excellent lubrication around control shaft 46 can be attained, and a connecting mechanism between electric motor 31 and control shaft 46 which are mounted to an outside of upper oil pan portion 14A can be simplified. Although in this embodiment, electric motor 31 by which high response property can be obtained is used as the actuator, a hydraulic actuator can be used instead.

Next, idle rotation speed control that forms an essential part of the present embodiment will be explained with reference to FIG. 5 to FIG. 13. During an idle operation in which the internal combustion engine is idling, idle rotation speed control for converging actual rotation speed rNe of the internal combustion engine to target idle rotation speed tNe is performed. Here, in the idle rotation speed control in the present embodiment, a deviation ΔNe between the actual rotation speed rNe and the target idle rotation speed tNe (ΔNe=tNe−rNe) is reduced and converged by conducting intake air quantity change control and mechanical compression ratio change control. That is, either one or both of intake air quantity and mechanical compression ratio as control targets are selected in accordance with magnitude of the deviation ΔNe, and the deviation ΔNe is reduced by changing the selected either one or both of intake air quantity and mechanical compression ratio.

Figure 5:
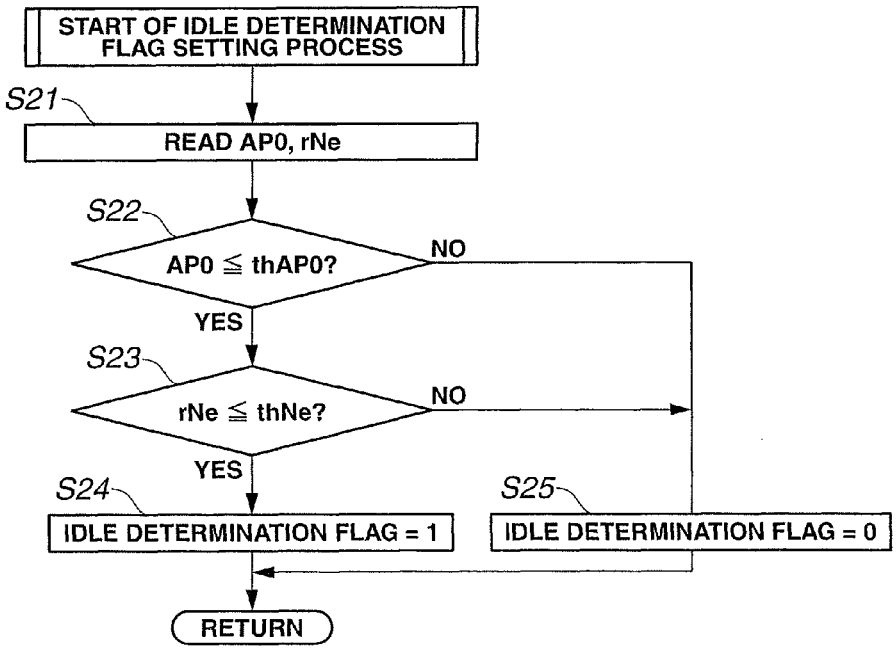
FIG. 5 is a flow chart showing details of a process of setting the idle determination flag shown in FIG. 4.

FIG. 4 is a flowchart showing a flow of a process of the idle rotation speed control. This routine is stored in the above-described ECU 40, and repeatedly executed at predetermined intervals (for example, every 10 ms). In step S11, a process of setting an idle determination flag indicating a determination result of idle operation is executed. FIG. 5 is a subroutine showing details of the process of setting the idle determination flag. In step S21, actual rotation speed rNe and accelerator opening degree APO detected by accelerator opening sensor 39 are read. The actual rotation speed rNe is a value obtained by detecting or estimating the actual rotation speed of the internal combustion engine. For instance, the actual rotation speed rNe is obtained by using an output signal of the above-described crank angle sensor 35 or using an output signal of cam angle sensor 35 that detects a cam angle of the camshaft and the output signal of the above-described crank angle sensor 35 (rotation speed detection section).

In step S22, it is determined whether the accelerator opening degree APO is equal to or smaller than a preset given threshold value thAPO. The threshold value thAPO is used to determine that the accelerator opening degree APO is substantially fully closed. The threshold value thAPO is set to "0" or a value approximate to "0". In step S23, it is determined whether the actual rotation speed rNe is equal to or lower than a given threshold value thNe. The threshold value thNe is set to a value slightly higher than target idle rotation speed tNe so as not to inhibit the operability by frequently making a changeover between idle rotation speed control and normal control.

When the accelerator opening degree APO is equal to or smaller than the threshold value thAPO and the actual rotation speed rNe is equal to or lower than the threshold value thNe, the logic flow proceeds to step S24 in which the idle determination flag is set to "1" indicating that it is in an idle operation state. Otherwise, that is, when the accelerator opening degree APO is larger than the threshold value thAPO or the actual rotation speed rNe is higher than the threshold value thNe, the logic flow proceeds to step S25 in which the idle determination flag is set to "0" indicating that it is not in the idle operation state.

Determination of the idle operation is not particularly limited to the above-described determination, and can be made by combining other conditions such as an ON state of a parking/neutral switch, an ON state of a brake pedal, vehicle speed equal to or lower than a given threshold value, etc.

Referring back to FIG. 4, in step S12, it is determined whether or not the idle determination flag set by a subroutine shown in FIG. 5 is "1". When the idle determination flag is "1", the logic flow proceeds to step S13 in which the idle speed control is executed. On the other hand, when the idle determination flag is "0", the logic flow proceeds to step S14 in which execution of the idle speed control is prohibited and normal control is carried out. In the normal control, the throttle opening degree is controlled so as to obtain required torque and intake air quantity corresponding to the accelerator opening degree APO, and the fuel injection amount is increased or reduced so as to maintain the target air-fuel ratio by the above-described air-fuel ratio feedback control, and also the variable valve operating mechanisms 28, 29 are driven and controlled in accordance with the accelerator opening degree APO, the actual rotation speed rNe and the like.

Figure 6:
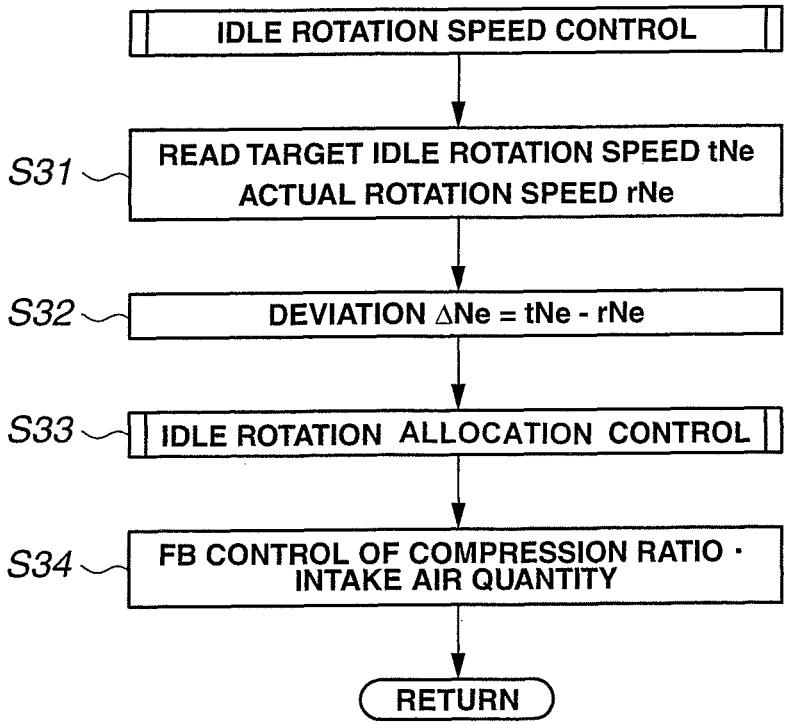
FIG. 6 is a flow chart showing details of idle rotation speed control shown in FIG. 4.

FIG. 6 is a subroutine showing details of the idle rotation speed control in step S13 in FIG. 4. In step S31, the target idle rotation speed tNe and the actual rotation speed rNe are read. The target idle rotation speed tNe is set in accordance with the cooling water temperature, operating conditions of auxiliary equipment such as an air conditioner, a gear position of an automatic transmission and the like. The target idle rotation speed tNe is corrected in accordance with battery voltage or the like. In step S32, the above-described deviation ΔNe between the target idle rotation speed tNe and the actual rotation speed rNe is determined.

In step S33, idle rotation allocation control is carried out based on the deviation ΔNe. That is, in accordance with magnitude of the deviation ΔNe, either one or both of the intake air quantity that is changed by throttle valve 23 and the mechanical compression ratio that is changed by variable compression ratio mechanism 30 are selected as control targets. Specifically, as described later, the deviation ΔNe is allocated to an intake air quantity control deviation ΔNe_Qa to be converged by intake air quantity change control and a compression ratio control deviation ΔNe_ϵ to be converged by mechanical compression ratio change control, on the basis of magnitude of the absolute value of the deviation ΔNe. As a result, notwithstanding that both the intake air quantity and the mechanical compression ratio are used as control targets to converge the same deviation ΔNe, it is possible to suppress hunting due to interference between the intake air quantity change control and the mechanical compression ratio change control.

Incidentally, an actual intake air quantity that is supplied to each cylinder in accordance with change of the mechanical compression ratio by variable compression ratio mechanism 30 is increased or decreased. However, the term "intake air quantity" as the control target means not such an actual intake air quantity but "intake air quantity" that is increased or decreased in accordance with the opening degree of throttle valve 23 that is used in the idle rotation speed control. A device that changes the "intake air quantity" as the control target is not particularly limited to throttle valve 23 described above. For example, the above-described variable valve operating mechanisms 28, 29 may be used solely or in combination with throttle valve 23.

In subsequent step S34, compression ratio/intake air quantity feedback (FB) control of the as explained later is carried out so as to reduce the deviation ΔNe by changing either one or both of the intake air quantity and the mechanical compression ratio selected by the idle rotation allocation control. In a case where the deviation ΔNe is reduced by changing the intake air quantity by the intake air quantity feedback control, throttle valve 23 is driven and controlled to increase the intake air quantity when the actual rotation speed rNe is lower than the target idle rotation speed tNe, and throttle valve 23 is driven and controlled to reduce the intake air quantity when the actual rotation speed rNe is higher than the target idle rotation speed tNe. Further, in a case where the deviation ΔNe is reduced by changing the mechanical compression ratio by the compression ratio feedback control, variable compression ratio mechanism 30 is driven and controlled to increase the mechanical compression ratio when the actual rotation speed rNe is lower than the target idle rotation speed tNe, and variable compression ratio mechanism 30 is driven and controlled to reduce the mechanical compression ratio when the actual rotation speed rNe is higher than the target idle rotation speed tNe.

Figure 7:
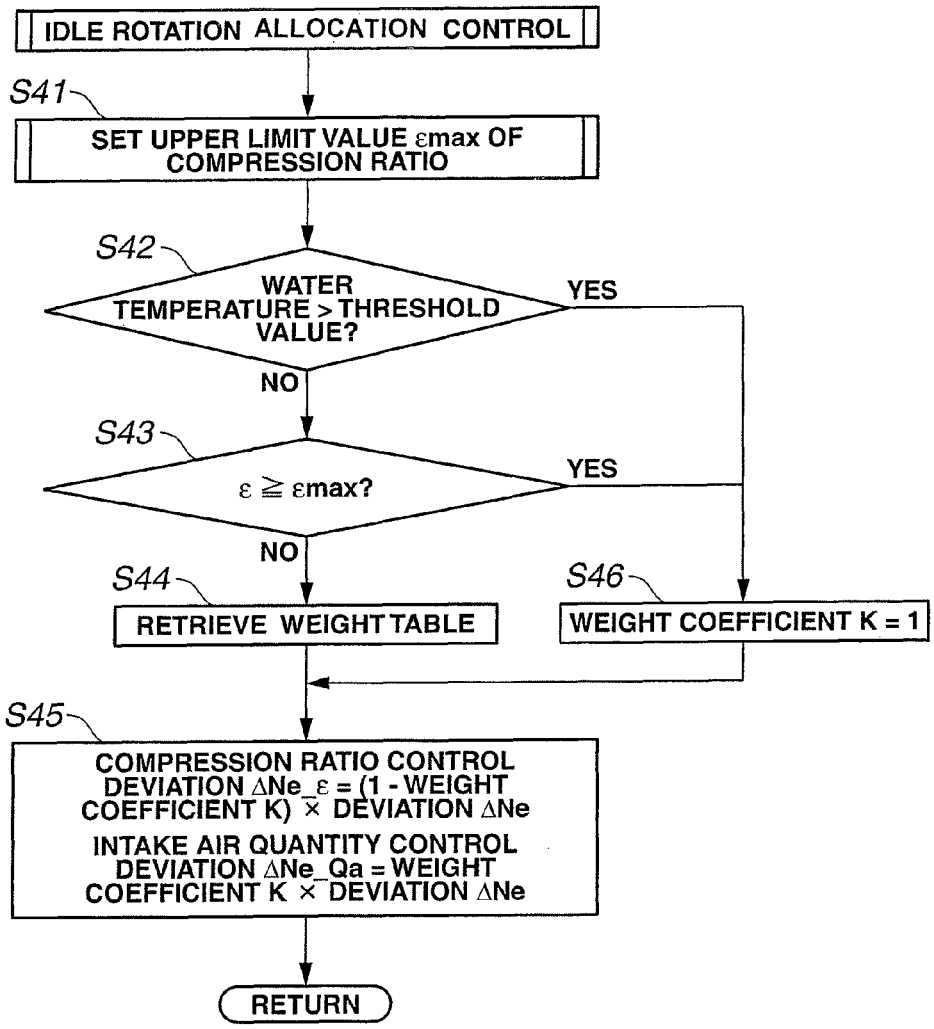
FIG. 7 is a flow chart showing details of idle rotation allocation control shown in FIG. 6.
Figure 8:
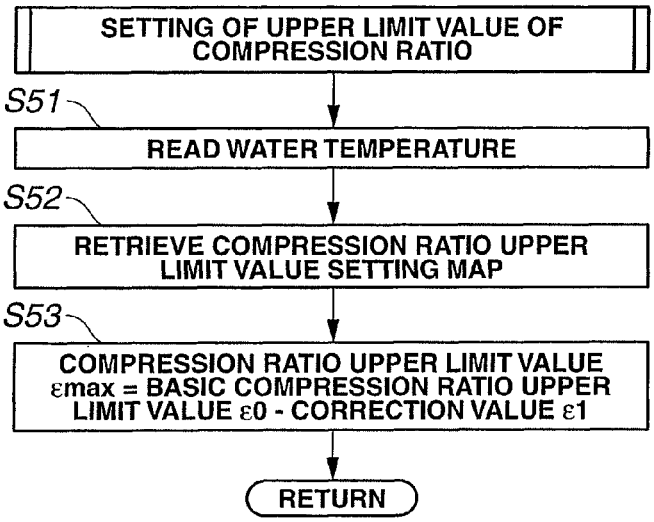
FIG. 8 is a flow chart showing details of a compression ratio upper limit value setting process shown in FIG. 7.
Figure 9:
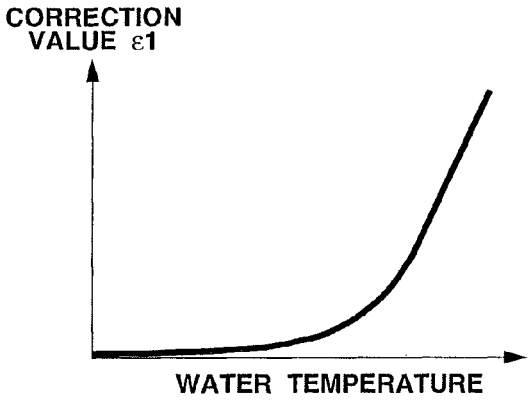
FIG. 9 is an explanatory diagram showing a map for setting the compression ratio upper limit.

FIG. 7 is a subroutine showing details of the idle rotation allocation control in the step S33 in FIG. 6. In step S41, an upper limit value ϵmax of the compression ratio which corresponds to a maximum mechanical compression ratio in a range in which knocking and pre-ignition do not occur in an idle operating condition is set. FIG. 8 is a subroutine showing details of a process of setting the upper limit value ϵmax of the compression ratio. In step S51, an engine water temperature corresponding to an engine temperature is read based on a detection signal of water temperature sensor 37. In step S52, a previously set and stored map for setting of the compression ratio upper limit value as shown in FIG. 9 is retrieved, and correction value ϵ1 is calculated in consideration of an influence of the engine water temperature.

In step S53, a final compression ratio upper limit value ϵmax (ϵmax=ϵ0-ϵ1) is determined by subtracting the correction value ϵ1 from a preset basic compression ratio upper limit value ϵ0. Here, the basic compression ratio upper limit value ϵ0 is a value corresponding to a maximum compression ratio at which knocking and pre-ignition do not occur in an idle operating condition when the engine water temperature is a steady water temperature (for example, 80° C.) after warming up. The correction value ϵ1 is a value corresponding to a decrement of the compression ratio which is caused in accordance with increase in engine water temperature. As the engine water temperature becomes higher, knocking and pre-ignition tend to more readily occur. Therefore, the correction value ϵ1 is increased in accordance with a rise in engine water temperature. Incidentally, although in this embodiment, the engine water temperature is used as a parameter corresponding to the engine temperature, the engine oil temperature or the intake air temperature which is detected or estimated by a sensor or the like may be used solely or in combination thereof.

Referring back to FIG. 7, in step S42, it is determined whether or not the engine water temperature exceeds a preset given threshold value. In step S43, it is determined whether or not the mechanical compression ratio has reached the compression ratio upper limit value max. The mechanical compression ratio ϵ used here is a control target value. However, a detection value or estimation value of the mechanical compression ratio which is detected or estimated by electric motor rotation angle sensor 32 or the like may be used.

Figure 10:
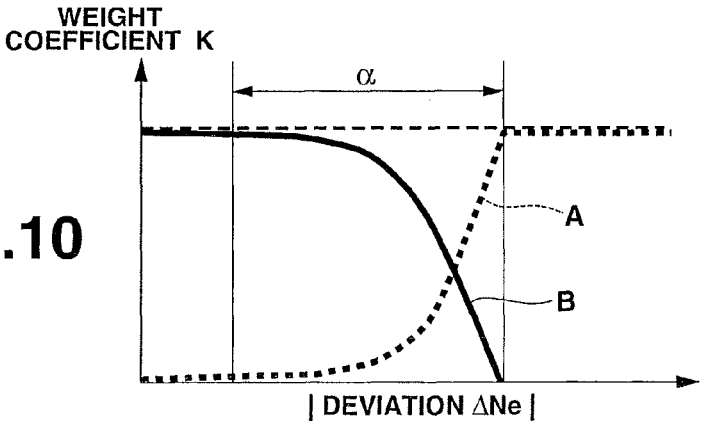
FIG. 10 is an explanatory diagram showing a table for setting a weight coefficient.

When the engine water temperature does not exceed the threshold value and the mechanical compression ratio does not reach than the compression ratio upper limit value max, the logic flow proceeds to step S44 in which a previously set and stored table for setting of a weight coefficient as shown in FIG. 10 is looked up by using the absolute value of the deviation ΔNe and the weight coefficient K is calculated. By using the weight coefficient K, a total deviation ΔNe is allocated to the intake air quantity control deviation ΔNe_Qa to be reduced by the intake air quantity change control and the compression ratio control deviation ΔNe_ϵ to be reduced by the mechanical compression ratio change control. Incidentally, a sum of the intake air quantity control deviation ΔNe_Qa and the compression ratio control deviation ΔNe_ϵ is the total deviation ΔNe.

A characteristic A indicated by broken line in FIG. 10 shows an example of the weight coefficient K. In this case, the weight coefficient K is a coefficient corresponding to a ratio of the intake air quantity control deviation ΔNe_Qa to the total deviation ΔNe. The weight coefficient K is set to continuously increase as the absolute value of the deviation ΔNe becomes larger. However, the weight coefficient K may be stepwise changed depending on the absolute value of the deviation ΔNe.

As shown in FIG. 10, when the absolute value of the deviation ΔNe is intermediate within a range a, the weight coefficient K is set to a value larger than 0 and smaller than 1. As a result, both the intake air quantity control deviation ΔNe_Qa and the compression ratio control deviation ΔNe_ϵ become larger than 0. Accordingly, in this case, the deviation ΔNe is reduced and converged by the idle rotation speed control using the intake air quantity change control and the mechanical compression ratio change control.

In step S45, the compression ratio control deviation ΔNe_ϵ and the intake air quantity control deviation ΔNe_Qa are calculated based on the weight coefficient K and the deviation ΔNe. The intake air quantity control deviation ΔNe_Qa is calculated by multiplying the deviation ΔNe by the weight coefficient K. On the other hand, the compression ratio control deviation ΔNe_ϵ is a value obtained by subtracting the intake air quantity control deviation ΔNe_Qa from the deviation ΔNe. The compression ratio control deviation ΔNe_ϵ is determined by multiplying the deviation ΔNe by (1−K).

Accordingly, as the deviation ΔNe between the target idle rotation speed tNe and the actual rotation speed rNe becomes larger, the weight coefficient K is set to a larger value so that the ratio of the intake air quantity control deviation ΔNe_Qa becomes larger. As the deviation ΔNe becomes smaller, the weight coefficient K is set to a smaller value so that the ratio of the compression ratio control deviation ΔNe_ϵ becomes larger. Thus, when the absolute value of the deviation ΔNe is relatively large, the intake air quantity control deviation ΔNe_Qa is increased to be larger than the compression ratio control deviation ΔNe_ϵ so that an excessive variation in the mechanical compression ratio is suppressed. As a result, it is possible to suppress deterioration of fuel economy and drop in drivability due to the excessive variation in the mechanical compression ratio, and suppress occurrence of knocking or pre-ignition. On the other hand, when the absolute value of the deviation ΔNe is relatively small, the compression ratio control deviation ΔNe_ϵ is increased to be larger than the intake air quantity control deviation ΔNe_Qa so that an amount of change of the mechanical compression ratio that is excellent in response properties is increased, and the deviation ΔNe can be quickly converged.

Referring back to FIG. 7, when the engine water temperature exceeds the threshold value or the mechanical compression ratio ϵ has reached the compression ratio upper limit value ϵmax, the logic flow proceeds from step S42 or S43 to step S46 in which the weight coefficient K is fixed to "1". As a result, the compression ratio control deviation ΔNe_ϵ becomes "0", and the intake air quantity control deviation ΔNe_Qa becomes equal to the deviation ΔNe.

That is, when the mechanical compression ratio ϵ has reached the compression ratio upper limit value ϵmax, regardless of magnitude of the deviation ΔNe, the mechanical compression ratio ϵ is prohibited from being changed and is fixed to the compression ratio upper limit value ϵmax, and only the intake air quantity is changed to thereby reduce the deviation ΔNe. As a result, it is possible to prevent the mechanical compression ratio ϵ from exceeding the compression ratio upper limit value ϵmax and suppress and avoid occurrence of knocking or pre-ignition. It is also possible to converge the deviation ΔNe by the intake air quantity change control.

When the engine water temperature exceeds the threshold value, the logic flow proceeds from step S42 to step S46 in which the weight coefficient K is fixed to "1". As a result, regardless of magnitude of the deviation ΔNe, the mechanical compression ratio ϵ is prohibited from being changed and is fixed to the compression ratio upper limit value ϵmax or a given mechanical compression ratio smaller than the compression ratio upper limit value max, and the intake air quantity is changed to thereby reduce the deviation ΔNe. As a result, it is possible to prevent the mechanical compression ratio ϵ from exceeding the compression ratio upper limit value ϵmax in accordance with a rise of the engine water temperature and suppress and avoid occurrence of knocking or pre-ignition. It is also possible to converge the deviation ΔNe by the intake air quantity change control. Incidentally, the determination process in step S42 may be omitted, and the correction weight coefficient K may be corrected in accordance with the engine water temperature. In this case, in order to obtain the above function and effect, when the engine water temperature exceeds the threshold value, the weight coefficient K is corrected to "1".

A characteristic B indicated by solid line in FIG. 10 shows another example of the weight coefficient K. In this case, the weight coefficient K is a coefficient corresponding to the ratio of the compression ratio control deviation ΔNe_ϵ to the total deviation ΔNe, and is set to continuously decrease as the absolute value of the deviation ΔNe becomes larger. However, the weight coefficient K may be stepwise changed depending on the absolute value of the deviation ΔNe.

In this case, unlike step S45 as described above, the compression ratio control deviation ΔNe_ϵ is determined by multiplying the deviation ΔNe by the weight coefficient K. The intake air quantity control deviation ΔNe_Qa is a value obtained by subtracting the compression ratio control deviation ΔNe_ϵ from the total deviation ΔNe. The intake air quantity control deviation ΔNe_Qa is obtained by multiplying the deviation ΔNe by (1−K). Further, unlike step S46 as described above, when the engine water temperature exceeds the threshold value or the mechanical compression ratio ϵ has reached the compression ratio upper limit value ϵmax, the weight coefficient K is set to "0".

Even in the case of the characteristic B, similarly to the case of the characteristic A, as the deviation ΔNe between the target idle rotation speed tNe and the actual rotation speed rNe becomes larger, the ratio of the intake air quantity control deviation ΔNe_Qa becomes larger. As the deviation ΔNe becomes smaller, the ratio of the compression ratio control deviation ΔNe_ϵ becomes larger.

Figure 11:
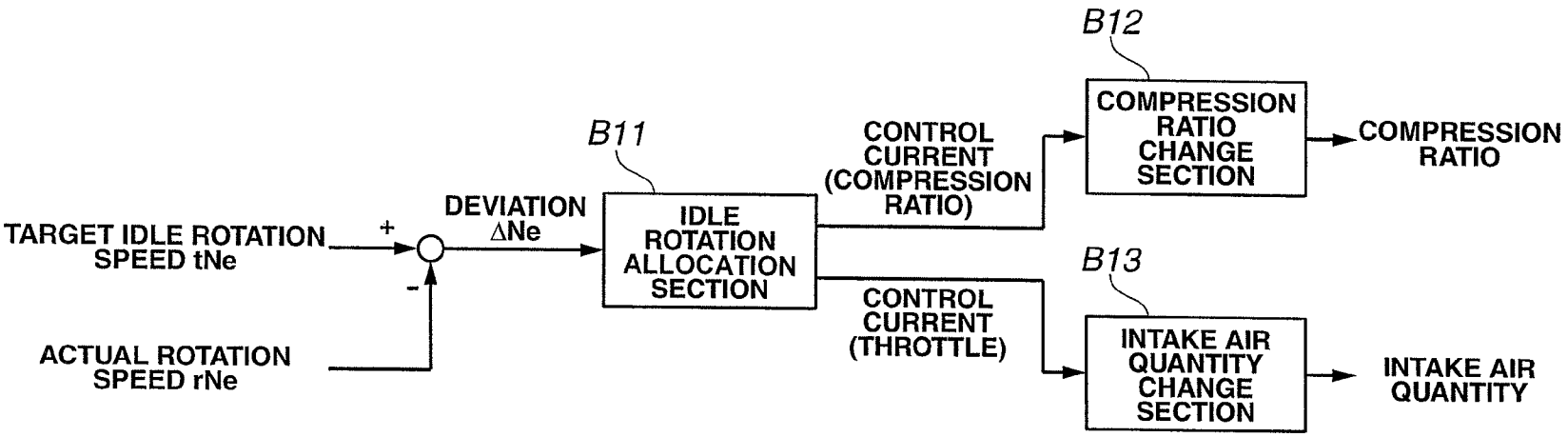
FIG. 11 is a block diagram schematically showing contents of the process of the idle rotation speed control.
Figure 12:
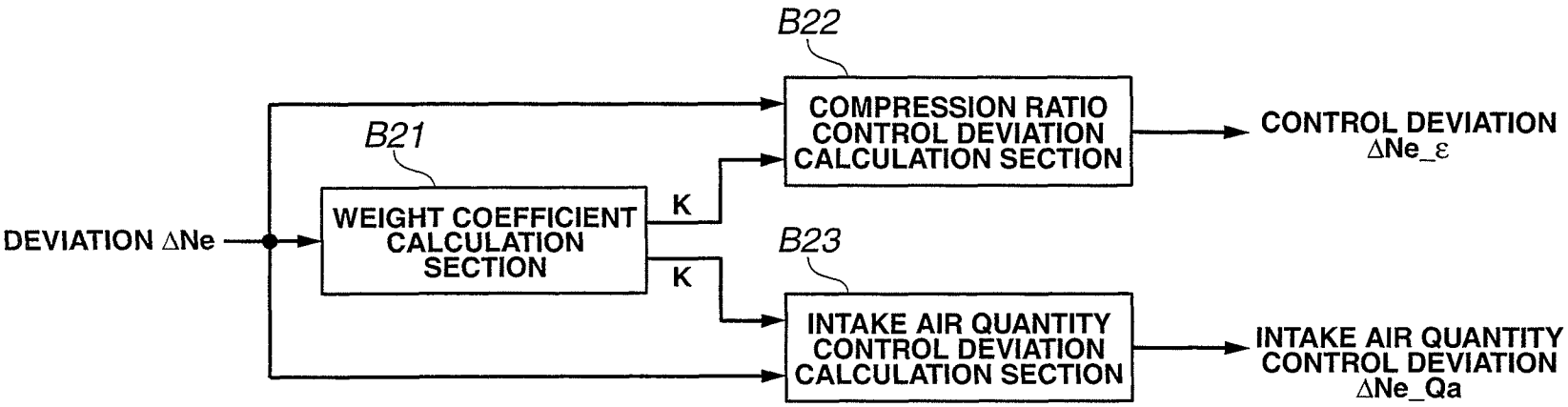
FIG. 12 is a block diagram showing details of an idle rotation allocation section shown in FIG. 11.
Figure 13:
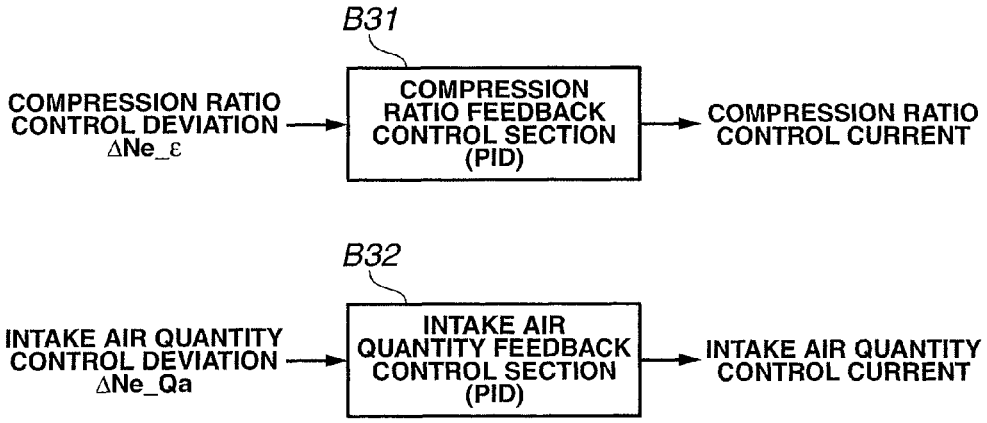
FIG. 13 is a block diagram showing details of the idle rotation allocation section shown in FIG. 11.

FIG. 11 to FIG. 13 are block diagrams schematically showing a flow of the process of the idle rotation speed control. In an idle rotation allocation section B11, based on the deviation ΔNe between the target idle rotation speed tNe and the actual rotation speed rNe, a compression ratio control current is outputted to electric motor 31 of variable compression ratio mechanism 30 as a compression ratio change section B12 and controls the mechanical compression ratio so as to reduce the compression ratio control deviation ΔNe_ϵ, and an intake air quantity control current is outputted to electronically controllable throttle valve 23 as an intake air quantity change section B13 and controls the intake air quantity so as to reduce the intake air quantity control deviation ΔNe_Qa.

FIG. 12 and FIG. 13 are block diagrams showing details of the idle rotation allocation section B11 shown in FIG. 11. In a weight coefficient calculation section B21, similarly to step S44 shown in FIG. 7, the weight coefficient K is calculated based on magnitude of the absolute value of the deviation ΔNe, and the weight coefficient K calculated is outputted to a compression ratio control deviation calculation section B22 and an intake air quantity control deviation calculation section B23. In the compression ratio control deviation calculation section B22 and the intake air quantity control deviation calculation section B23, similarly to step S45, the compression ratio control deviation ΔNe_ϵ and the intake air quantity control deviation ΔNe_Qa are calculated based on the weight coefficient K and the deviation ΔNe, respectively. As shown in FIG. 13, in a compression ratio feedback control section B31, based on the compression ratio control deviation ΔNe_ϵ calculated, deviation reduction control such as known PID control is carried out to determine the compression ratio control current, and the compression ratio control current determined is outputted to electric motor 31 of variable compression ratio mechanism 30 so that electric motor 31 of variable compression ratio mechanism 30 is driven and controlled to make the compression ratio control deviation ΔNe_ϵ close to "0". Specifically, variable compression ratio mechanism 30 is driven and controlled such that the mechanical compression ratio is increased when the actual rotation speed rNe is lower than the target idle rotation speed tNe, and the mechanical compression ratio is decreased when the actual rotation speed rNe is higher than the target idle rotation speed tNe.

Similarly, in an intake air quantity feedback control section B32, based on the intake air quantity control deviation ΔNe_Qa calculated, deviation reduction control such as known PID control is carried out to determine the intake air quantity control current, and the intake air quantity control current determined is outputted to electronically controllable throttle valve 23 so that electronically controllable throttle valve 23 is driven and controlled to make the intake air quantity control deviation ΔNe_Qa close to "0". Specifically, electronically controllable throttle valve 23 is driven and controlled such that the intake air quantity is increased when the actual rotation speed rNe is lower than the target idle rotation speed tNe, and the intake air quantity is decreased when the actual rotation speed rNe is higher than the target idle rotation speed tNe.

As explained above, in the present embodiment, in the idle rotation speed control, the deviation ΔNe between the target idle rotation speed tNe and the actual rotation speed rNe is reduced by using the intake air quantity and the mechanical compression ratio. With this construction, it is possible to converge quickly the deviation ΔNe by utilizing the characteristics of both the intake air quantity and the mechanical compression ratio. Further, the total deviation ΔNe is allocated to the intake air quantity control deviation ΔNe_Qa that is reduced by changing the intake air quantity and the compression ratio control deviation ΔNe_ϵ that is reduced by changing the mechanical compression ratio. Therefore, the intake air quantity and the mechanical compression ratio can be feedback-controlled independently of each other, so that interference therebetween and occurrence of hunting can be suppressed. Further, in a case where the absolute value of the deviation ΔNe is large, the intake air quantity control deviation ΔNe_Qa is increased while the compression ratio control deviation ΔNe_ϵ is decreased. As a result, it is possible to suppress occurrence of knocking or pre-ignition due to an excessive change of the mechanical compression ratio while stably maintaining engine rotation speed close to the target idle rotation speed by changing the intake air quantity mainly. On the other hand, in a case where the absolute value of the deviation ΔNe is small, the compression ratio control deviation ΔNe_ϵ is increased to preferentially carry out control of changing the mechanical compression ratio that serves for excellent response properties. As a result, the deviation ΔNe can be quickly converged. Further, it is possible to suppress drop in drivability due to a rapid variation in allocation ratio by continuously or stepwise changing the weight coefficient K corresponding to the allocation ratio between the intake air quantity control deviation ΔNe_Qa and the compression ratio control deviation ΔNe_ϵ in accordance with magnitude of the absolute value of the deviation ΔNe.

Furthermore, although the embodiment in which the present invention is applied to idle rotation speed control is explained above, the present invention can be applied to various control to bring engine rotation speed close to a target rotation speed in such a case that in a hybrid vehicle, an electric motor is rotationally driven at a target rotation speed so as to generate electric power by an internal combustion engine.

The invention claimed is:

1. An apparatus for controlling rotation speed of an internal combustion engine, comprising:

an intake air quantity change section configured to change an intake air quantity in the internal combustion engine;

a compression ratio change section configured to change a mechanical compression ratio in the internal combustion engine;

a rotation speed detection section configured to detect actual rotation speed of the internal combustion engine; and a control section configured to calculate a deviation between a target rotation speed and the actual rotation speed during execution of rotation speed control to bring the actual rotation speed of the internal combustion engine close to the target rotation speed, select either one or both of the intake air quantity and the mechanical compression ratio as control targets in accordance with magnitude of the deviation, and reduce the deviation by changing the selected either one or both of the intake air quantity and the mechanical compression ratio.

2. The apparatus for controlling rotation speed of an internal combustion engine as claimed in claim 1, wherein the control section is configured to reduce the deviation by changing the intake air quantity mainly when an absolute value of the deviation is relatively large, and reduce the deviation by changing the mechanical compression ratio mainly when the absolute value of the deviation is relatively small.

3. The apparatus for controlling rotation speed of an internal combustion engine as claimed in claim 2, wherein the control section is configured to reduce the deviation by changing both of the intake air quantity and the mechanical compression ratio when the absolute value of the deviation is intermediate.

4. The apparatus for controlling rotation speed of an internal combustion engine as claimed in claim 1, wherein the control section is configured to allocate the deviation to an intake air quantity control deviation and a compression ratio control deviation on a basis of the deviation and the absolute value of the deviation, and change the intake air quantity in accordance with the intake air quantity control deviation and change the mechanical compression ratio in accordance with the compression ratio control deviation.

5. The apparatus for controlling rotation speed of an internal combustion engine as claimed in claim 4, wherein the control section is configured to increase the intake air quantity control deviation to be larger than the compression ratio control deviation when the absolute value of the deviation is relatively large, and increase the compression ratio control deviation to be larger than the intake air quantity control deviation when the absolute value of the deviation is relatively small.

6. The apparatus for controlling rotation speed of an internal combustion engine as claimed in claim 4, wherein the control section is configured to calculate a weight coefficient that increases as the absolute value of the deviation becomes larger, calculate the intake air quantity control deviation by multiplying the deviation by the weight coefficient, and calculate the compression ratio control deviation by subtracting the intake air quantity control deviation from the deviation.

7. The apparatus for controlling rotation speed of an internal combustion engine as claimed in claim 6, wherein the weight coefficient is set to continuously or stepwise increase as the absolute value of the deviation becomes larger.

8. The apparatus for controlling rotation speed of an internal combustion engine as claimed in claim 4, wherein the control section is configured to calculate a weight coefficient that decreases as the absolute value of the deviation becomes larger, calculate the compression ratio control deviation by multiplying the deviation by the weight coefficient, and calculate the intake air quantity control deviation by subtracting the compression ratio control deviation from the deviation.

9. The apparatus for controlling rotation speed of an internal combustion engine as claimed in claim 8, wherein the weight coefficient is set to continuously or stepwise decrease as the absolute value of the deviation becomes larger.

10. The apparatus for controlling rotation speed of an internal combustion engine as claimed in claim 1, wherein the control section is configured to reduce the deviation by changing the intake air quantity regardless of magnitude of the deviation when the mechanical compression ratio has reached a compression ratio upper limit value during execution of the rotation speed control to bring the actual rotation speed of the internal combustion engine close to the target rotation speed.

11. The apparatus for controlling rotation speed of an internal combustion engine as claimed in claim 10, wherein the control section is configured to correct the compression ratio upper limit value in accordance with engine temperature.

12. The apparatus for controlling rotation speed of an internal combustion engine as claimed in claim 1, wherein the control section is configured to reduce the deviation by changing the intake air quantity mainly regardless of magnitude of the deviation when an engine temperature is higher than a preset threshold value.

13. An apparatus for controlling rotation speed of an internal combustion engine, comprising:

an intake air quantity change section configured to change an intake air quantity in the internal combustion engine;

a compression ratio change section configured to change a mechanical compression ratio in the internal combustion engine; and a rotation speed detection section configured to detect actual rotation speed of the internal combustion engine, wherein a deviation between a target rotation speed and the actual rotation speed is calculated during execution of rotation speed control to bring the actual rotation speed of the internal combustion engine close to the target rotation speed, either one or both of the intake air quantity and the mechanical compression ratio as control targets is selected in accordance with magnitude of the deviation, and the deviation is reduced by changing the selected either one or both of the intake air quantity and the mechanical compression ratio.

14. An apparatus for controlling rotation speed of an internal combustion engine, comprising:

an intake air quantity changing means for changing an intake air quantity in the internal combustion engine;

a compression ratio changing means for changing a mechanical compression ratio in the internal combustion engine;

a rotation speed detection means for detecting actual rotation speed of the internal combustion engine; and a control means for calculating a deviation between a target rotation speed and the actual rotation speed during execution of rotation speed control to bring the actual rotation speed of the internal combustion engine close to the target rotation speed, the control means selecting either one or both of the intake air quantity and the mechanical compression ratio as control targets in accordance with magnitude of the deviation, the control means reducing the deviation by changing the selected either one or both of the intake air quantity and the mechanical compression ratio.

15. A method for controlling rotation speed of an internal combustion engine, comprising:

changing an intake air quantity in the internal combustion engine;

changing a mechanical compression ratio in the internal combustion engine;

detecting actual rotation speed of the internal combustion engine;

calculating a deviation between a target rotation speed and the actual rotation speed during execution of rotation speed control to bring the actual rotation speed of the internal combustion engine close to the target rotation speed;

selecting either one or both of the intake air quantity and the mechanical compression ratio as control targets in accordance with magnitude of the deviation; and reducing the deviation by changing the selected either one or both of the intake air quantity and the mechanical compression ratio.

* * * * *